US011473436B2

(12) United States Patent
Verma et al.

(10) Patent No.: US 11,473,436 B2
(45) Date of Patent: Oct. 18, 2022

(54) SEAL ASSEMBLY

(71) Applicant: General Electric Company, Schenectady, NY (US)

(72) Inventors: Naleen Kumar Verma, Bangalore (IN); Dharmaraj Pachaiappan, Bangalore (IN); Ronald Bruce Schofield, Clarksville, OH (US); Daniel Drew Smith, Mason, OH (US); Sudeep Pradhan Sadananda Rao, Bangalore (IN); Joseph John Bischof, West Chester, OH (US); Stephen Gerard Matava, Andover, MA (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 301 days.

(21) Appl. No.: 16/601,093

(22) Filed: Oct. 14, 2019

(65) Prior Publication Data

US 2021/0108527 A1 Apr. 15, 2021

(51) Int. Cl.
*F01D 11/00* (2006.01)

(52) U.S. Cl.
CPC ..... *F01D 11/00* (2013.01); *F05D 2220/323* (2013.01)

(58) Field of Classification Search
CPC ..... F01D 11/00; F01D 11/005; F02C 7/28; F02C 7/24
See application file for complete search history.

(56) References Cited

U.S. PATENT DOCUMENTS

| | | | | |
|---|---|---|---|---|
| 4,331,338 | A | 5/1982 | Caldwell et al. | |
| 4,656,689 | A | 4/1987 | Dennis | |
| 4,758,028 | A | 7/1988 | Davies et al. | |
| 4,894,966 | A | 1/1990 | Bailey et al. | |
| 5,071,143 | A * | 12/1991 | Byerly | F16L 5/025 277/944 |
| 5,299,811 | A | 4/1994 | Kershaw | |
| 5,331,946 | A | 7/1994 | Yamini et al. | |
| 5,458,343 | A | 10/1995 | Domfeld et al. | |
| 5,950,277 | A | 9/1999 | Tallmadge et al. | |
| 6,029,412 | A | 2/2000 | Gohlke | |
| 6,883,836 | B2 * | 4/2005 | Breay | F16L 25/01 285/145.4 |
| 7,828,298 | B2 | 11/2010 | Cummings | |
| 8,096,017 | B2 | 1/2012 | Van Walraven et al. | |
| 8,876,119 | B2 | 11/2014 | Braun et al. | |

(Continued)

*Primary Examiner* — Sabbir Hasan
(74) *Attorney, Agent, or Firm* — Venable LLP; Michele V. Frank

(57) ABSTRACT

A gas turbine engine including a wall assembly, a seal assembly, and a member extended through the wall assembly is provided. The wall assembly defines an opening through which the member is extended, and the wall assembly defines a first side and a second side opposite of the first side along a direction of extension of the member through the wall assembly. The seal assembly includes a retaining portion extended at least partially co-directional to the member. The retaining portion is configured to couple around the member and extend through the opening. The seal assembly further includes a locking portion configured to sealingly attach to the wall assembly and the retaining portion at an interface between the locking portion and the retaining portion.

10 Claims, 10 Drawing Sheets

(56) References Cited

U.S. PATENT DOCUMENTS

| | | | |
|---|---|---|---|
| 9,647,438 | B2 | 5/2017 | Scheuer et al. |
| 2004/0168398 | A1 | 9/2004 | Sakno et al. |
| 2007/0114791 | A1 | 5/2007 | Williams |

* cited by examiner

SEAL ASSEMBLY

FIELD

The present subject matter relates to seal assemblies for wall pass-throughs for aircraft gas turbine engines. The present subject matter further relates to seal assemblies for conduit-wall pass-throughs generally, including conduit-wall pass-throughs for heat engines, gas turbine engines, or propulsion systems.

BACKGROUND

Conduits, manifolds, pipes, electrical wiring systems, or other structures may extend or pass-through walls and require seals to prevent fluid passage or heat transfer between the conduit and wall interface. In certain heat engines, such as turbo machines or aircraft gas turbine engines, firewalls and bulkheads may be required to perform certain fire prevention or fire protection functions, such as to mitigate spread or communication of undesired conditions across the firewall or bulkhead. Many seal assemblies, such as those for firewall-conduit pass-through seals, or particularly firewall conduit pass-through seals for aircraft engines, may misalign when joined and assembled together. Such misalignments may result in material losses at the wall or the seal assembly, and may therefore increase the opening between the wall and the seal assembly such as to allow unacceptable fluid or thermal leakage across the wall. Such leakage may adversely compromise fire or thermal protection between a fire zone and an ignition zone, or other divisions between a relatively hazardous environment and a relatively fire or thermal sensitive environment. Such compromised protection may prevent certification of a propulsion system, such as an aircraft propulsion system, and/or result in partial or complete loss of an aircraft or propulsion system attached to an aircraft.

Additionally, or alternatively, many seal assemblies include mechanical fasteners that may introduce complexities in the design or assembly of the seal assembly. Mechanical fasteners may additionally increase risk of foreign object debris damage resulting from loose or unsecured fasteners such as bolts, nuts, washers, or screws.

As such, there is a need for improved seal assemblies for wall-conduit pass through interfaces. Furthermore, there is a need for improved seal assemblies that prevent fluid leakage or heat transfer across a wall. Still furthermore, there is a need for improved seal assemblies that may mitigate fluid, heat, or chemical transfer across a barrier structure for an aircraft propulsion system.

BRIEF DESCRIPTION

Aspects and advantages of the invention will be set forth in part in the following description, or may be obvious from the description, or may be learned through practice of the invention.

An aspect of the present disclosure is directed to a gas turbine engine, including gas turbine engines for aircraft, marine apparatuses, or land-based apparatuses. The gas turbine engine includes a wall assembly defining an opening through which a member is extended. The wall assembly separates the gas turbine engine into two or more zones including a hazardous zone or first zone and an environmentally sensitive zone or second zone. The first zone includes an ignition source and the second zone includes a flammable fluid source. The member is extended along a direction of extension through the wall assembly and positioned at least at the first zone and the second zone. The propulsion system includes a retaining device including a retaining portion extended at least partially co-directional to the member, and further including a resilient member coupled to the retaining portion and the wall assembly. A seal surrounds the member and is coupled to the retaining portion and the member. A locking portion is sealingly attached to the wall assembly and the retaining portion at an interface extended at least partially circumferentially around the member. The interface is positioned between the locking portion and the retaining portion Another aspect of the present disclosure is directed to a seal assembly for a wall assembly and a member extended through the wall assembly. The wall assembly defines an opening through which the member is extended, and the wall assembly defines a first side and a second side opposite of the first side along a direction of extension of the member through the wall assembly. The seal assembly includes a retaining portion extended at least partially co-directional to the member. The retaining portion is configured to couple around the member and extend through the opening. The seal assembly further includes a locking portion configured to sealingly attach to the wall assembly and the retaining portion at an interface between the locking portion and the retaining portion.

In various embodiments, the interface defines a sloped interface including a variably extended section of the retaining portion and the locking portion extended into one another. In one embodiment, the variably extended section of the interface is extended relative to at least an arc of a circumference of the opening through the wall assembly.

In still various embodiments, the locking portion is sealingly attached to the wall assembly and the retaining portion via a friction fit. In one embodiment, the friction fit at the locking portion includes a protrusion extended from the locking portion to the wall assembly. In another embodiment, the protrusion extended from the locking portion is variably extended from the locking portion to the wall assembly relative to at least a portion of a circumference of the opening through the wall assembly.

In various embodiments, the retaining portion includes a first retaining wall extended at least partially perpendicular to the direction of extension of the member. The first retaining wall is configured to be positioned adjacent to the first side of the wall assembly. A second retaining wall is extended at least partially perpendicular to the direction of extension of the member. The second retaining wall is configured to be positioned adjacent to the second side of the wall assembly.

In one embodiment, the locking portion includes a key configured to be extended toward the second side of the wall assembly. The retaining portion includes a slot through the second retaining wall, the slot corresponding to the key at the locking portion.

In still various embodiments, the seal assembly further includes a resilient member configured to connect the retaining portion to the wall assembly. In one embodiment, the resilient member is configured to be positioned between the first side of the wall assembly and a first retaining wall of the retaining portion, the first retaining wall configured to be extended adjacent to the first side of the wall assembly. In another embodiment, the resilient member is integrally connected to the first retaining wall. In yet another embodiment, the resilient member includes springing properties.

In one embodiment, the seal assembly further includes a seal configured to be positioned between the member and the retaining portion, the seal and the retaining portion each configured to surround the member.

In another embodiment, the retaining portion includes two or more separable retaining portions together configured to surround the member, the two or more retaining portions configured to attach to the locking portion.

In still another embodiment, the locking portion includes two or more separable locking portions together configured to surround the retaining portion, the two or more separable locking portions together configured to attach to the wall assembly and the retaining portion.

Another aspect of the present disclosure is directed to an apparatus. In various embodiments, the apparatus defines a heat engine, turbo machine, gas turbine engine, or a propulsion system. In certain embodiments, the apparatus is a turbo machine or propulsion system for an aircraft. The apparatus includes a wall assembly defining an opening through which a member is extended. The wall assembly defines a first side and a second side opposite of the first side along a direction of extension of the member through the wall assembly. The apparatus includes a retaining device including a retaining portion extended at least partially co-directional to the member. A resilient member is coupled to the retaining portion and the wall assembly and a seal surrounds the member. The seal is coupled to the retaining portion and the member. A locking portion is sealingly attached to the wall assembly and the retaining portion at an interface extended at least partially circumferentially around the member. The interface is positioned between the locking portion and the retaining portion.

In various embodiment, the retaining portion includes a first retaining wall extended at least partially perpendicular to the direction of extension of the member, wherein the first retaining wall is positioned adjacent to the first side of the wall assembly, and a second retaining wall extended at least partially perpendicular to the direction of extension of the member, wherein the second retaining wall is positioned adjacent to the second side of the wall assembly.

In one embodiment, the resilient member is connected to the first retaining wall and the wall assembly at the first side, and the locking portion is sealingly attached to the second retaining wall and the wall assembly at the second side.

In another embodiment, the sloped interface is defined at least partially circumferentially at the second retaining wall. The sloped interface defines a variably extended section extended at least partially along the direction of extension of the member toward the locking portion.

In still another embodiment, the wall assembly defines a depression at which a protrusion is extended from the locking portion in contact with the wall assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
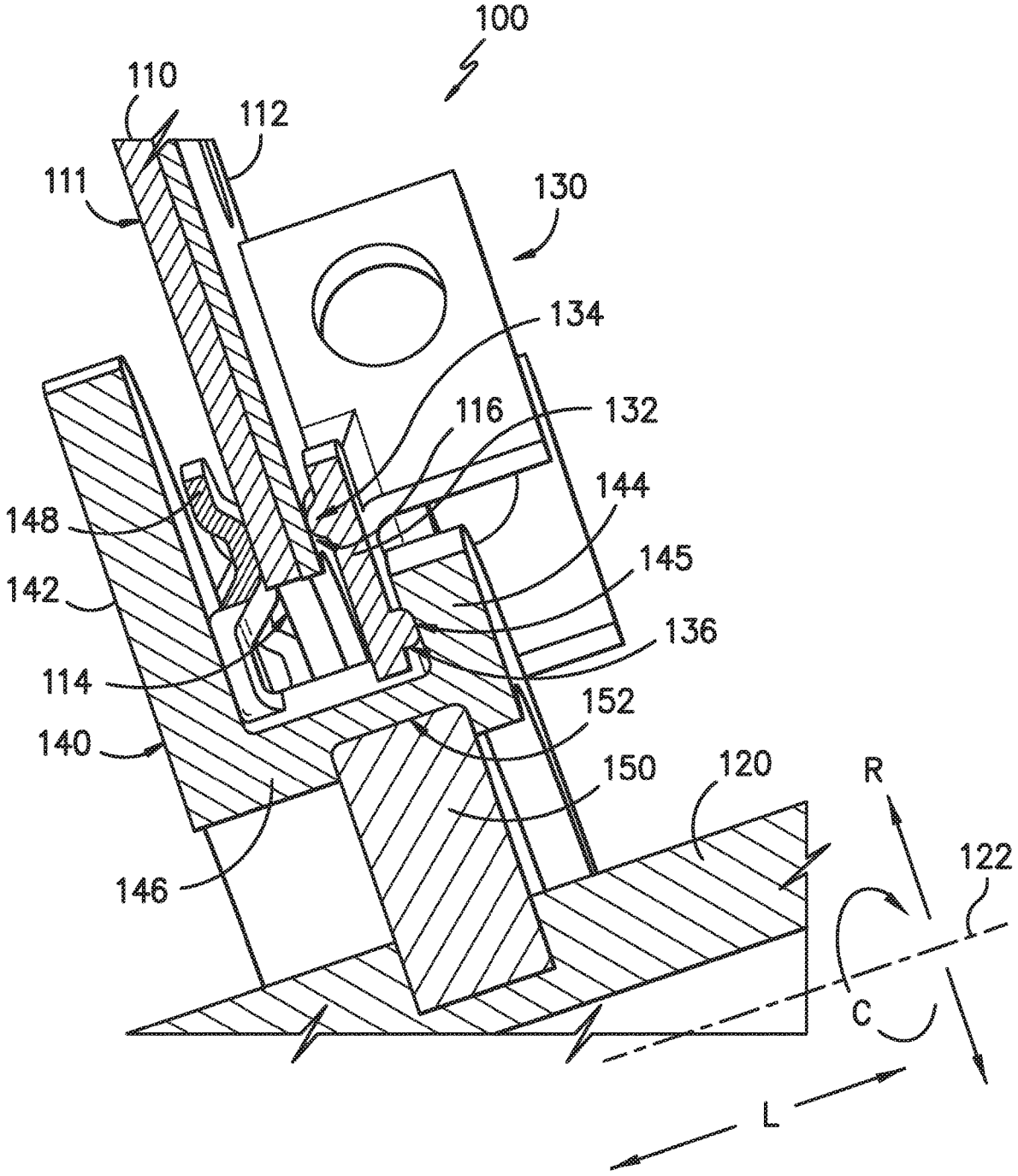
FIG. 1 is a cutaway side view of an exemplary embodiment of a seal assembly according to an aspect of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms “first”, “second”, and “third” may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Embodiments of an apparatus including embodiments of a seal assembly are provided. The embodiments of the seal assembly provided herein may provide improved seal assembly alignment relative to a conduit or other pass-through structure through a wall assembly. The embodiments provided herein include retention devices and features that may obviate a need or mechanical fasteners, such as to reduce or eliminate risks relative to foreign object debris (FOD) damage to an aircraft or turbo machine or propulsion system for an aircraft, marine apparatus, or land-based apparatus. The seal assembly and apparatus may provide a near or substantially zero-gap fire seal alignment to a conduit or member extended through the wall assembly. The various embodiments of the seal assembly and apparatus provided herein may mitigate or eliminate leakage across the wall assembly, such as to mitigate heat transfer, fluid transfer, or damage from one side of the wall assembly to another side of the wall assembly. Additionally, or alternatively, embodiments provided herein may provide a relatively less complex assembly, such as to improve installation, ergonomics, or reduce FOD risk.

Referring now to the drawings, FIG. 1 is a perspective cross sectional view of a portion of a seal assembly 100 for an apparatus 10. The apparatus 10 includes a wall assembly 110 defining an opening 114 through which a member 120 is extended. A reference direction of extension or longitudinal direction L is depicted for reference. A circumferential direction C relative to a centerline axis 122 of the member 120 is depicted for reference. The wall assembly 110 defines a first side 111 and a second side 112 opposite of the first side 111 along the direction of extension or longitudinal direction L of the member 120 through the wall assembly 110.

The seal assembly 100 includes a retaining device including a retaining portion 140. The retaining portion 140 is extended at least partially co-directional (e.g., along the longitudinal direction L) to the member 120. The seal assembly 100 further includes a locking portion 130 sealingly attached to the wall assembly 110 and the retaining portion 140. An interface 145 is defined between the retaining portion 140 and the locking portion 130. In various embodiments, the interface 145 defines a sloped interface at which one or more of the retaining portion 140 and the locking portion 130 is extended into one another. In certain embodiments, the interface 145 defining a sloped interface is extended at least partially circumferentially around the member 120. The interface 145 is positioned between the locking portion 130 and the retaining portion 140.

Figure 2B:
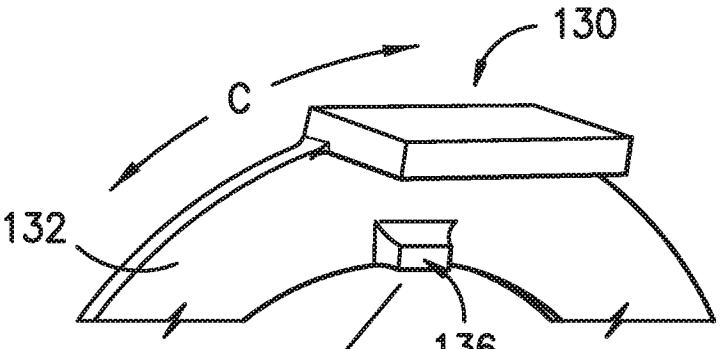
FIG. 2B is a perspective view of an exemplary embodiment of a portion of the seal assembly according to an aspect of the present disclosure.
Figure 2A:
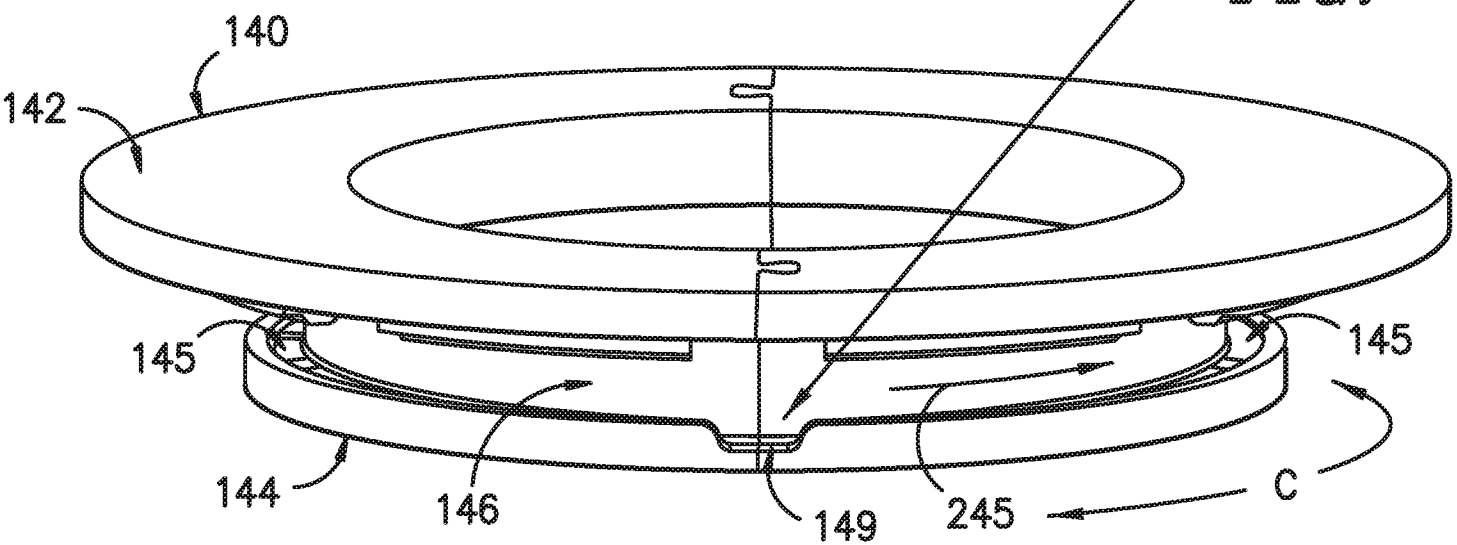
FIG. 2A is a perspective view of an exemplary embodiment of a portion of the seal assembly according to an aspect of the present disclosure.
Figure 3:
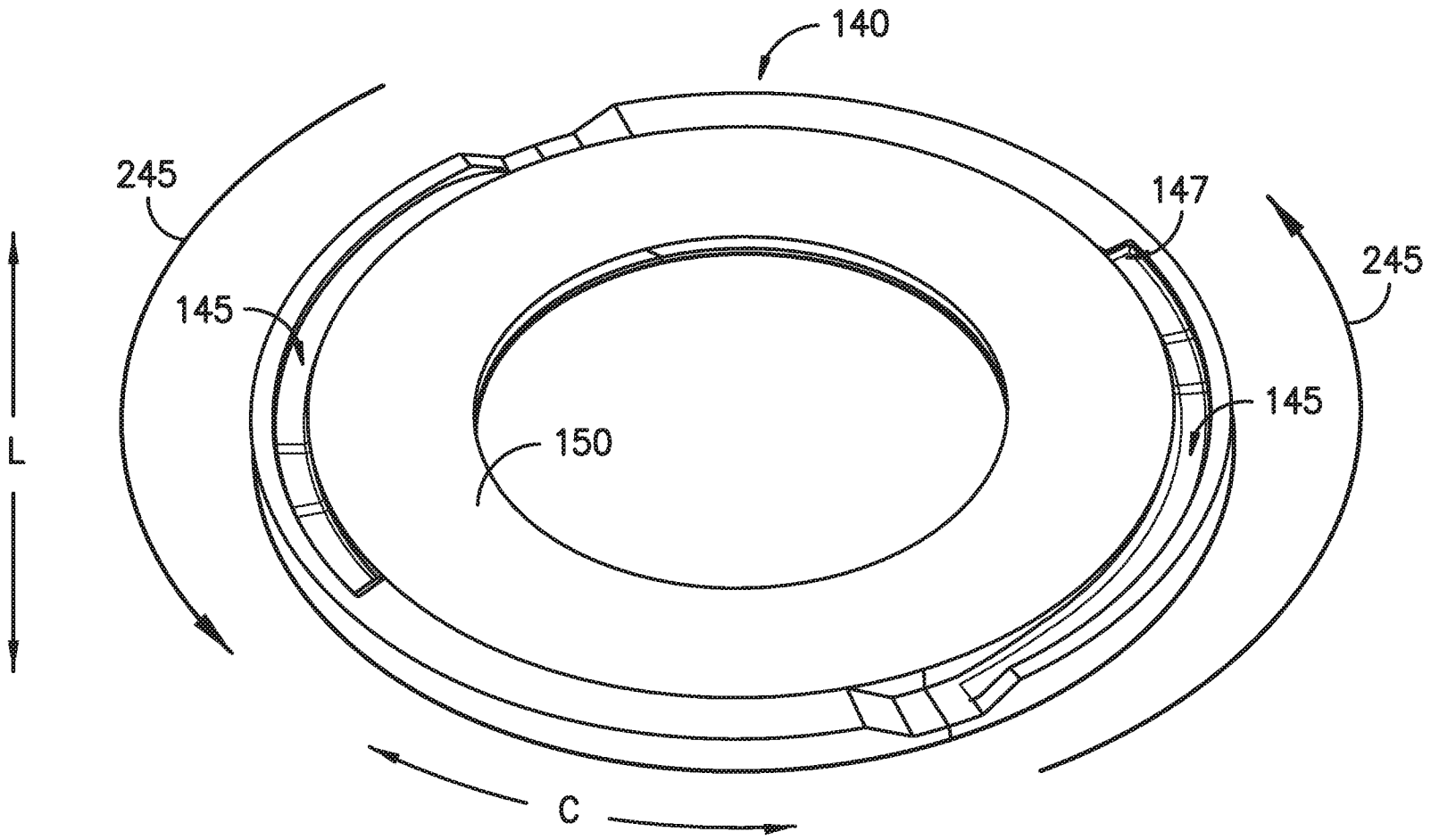
FIG. 3 is a perspective view of another exemplary embodiment of another portion of the seal assembly according to an aspect of the present disclosure.

Referring to FIGS. 2-3, perspective views of embodiments of the retaining portion 140 are provided. Referring to FIGS. 1-2, the retaining portion 140 includes a first retaining wall 142 extended at least partially perpendicular to the direction of extension or longitudinal direction L of the member 120. The first retaining wall 142 is positioned adjacent or next to the first side 111 of the wall assembly 110. The retaining portion 140 may further include a second retaining wall 144 extended at least partially perpendicular to the direction of extension of the member 120. The second retaining wall 144 is positioned adjacent or next to the second side 112 of the wall assembly 110.

The first retaining wall 142 and the second retaining wall 144 may each be connected together by a third wall 146 configured to extend through the opening 114 of the wall assembly 110. The third wall 146 may generally position the first retaining wall 142 adjacent or next to the first side 111 of the wall assembly 110 and further position the second retaining wall 144 adjacent or next to the second side 112 of the wall assembly 110. In various embodiments, the second retaining wall 144 is shorter than the first retaining wall 142 along a radial direction R from the centerline axis 122. In one embodiment, the second retaining wall 144 is sized to fit through the opening 114 of the wall assembly 110. In another embodiment, the first retaining wall 142 is sized to provide a surface or interface at which the wall assembly 110 reacts, such as the first side 111 of the wall assembly 110. In certain embodiments, the seal assembly 100 includes the serial arrangement of the first retaining wall 142, the wall assembly 110, the locking portion 130, and the second retaining wall 144 along the longitudinal direction.

Figure 10:
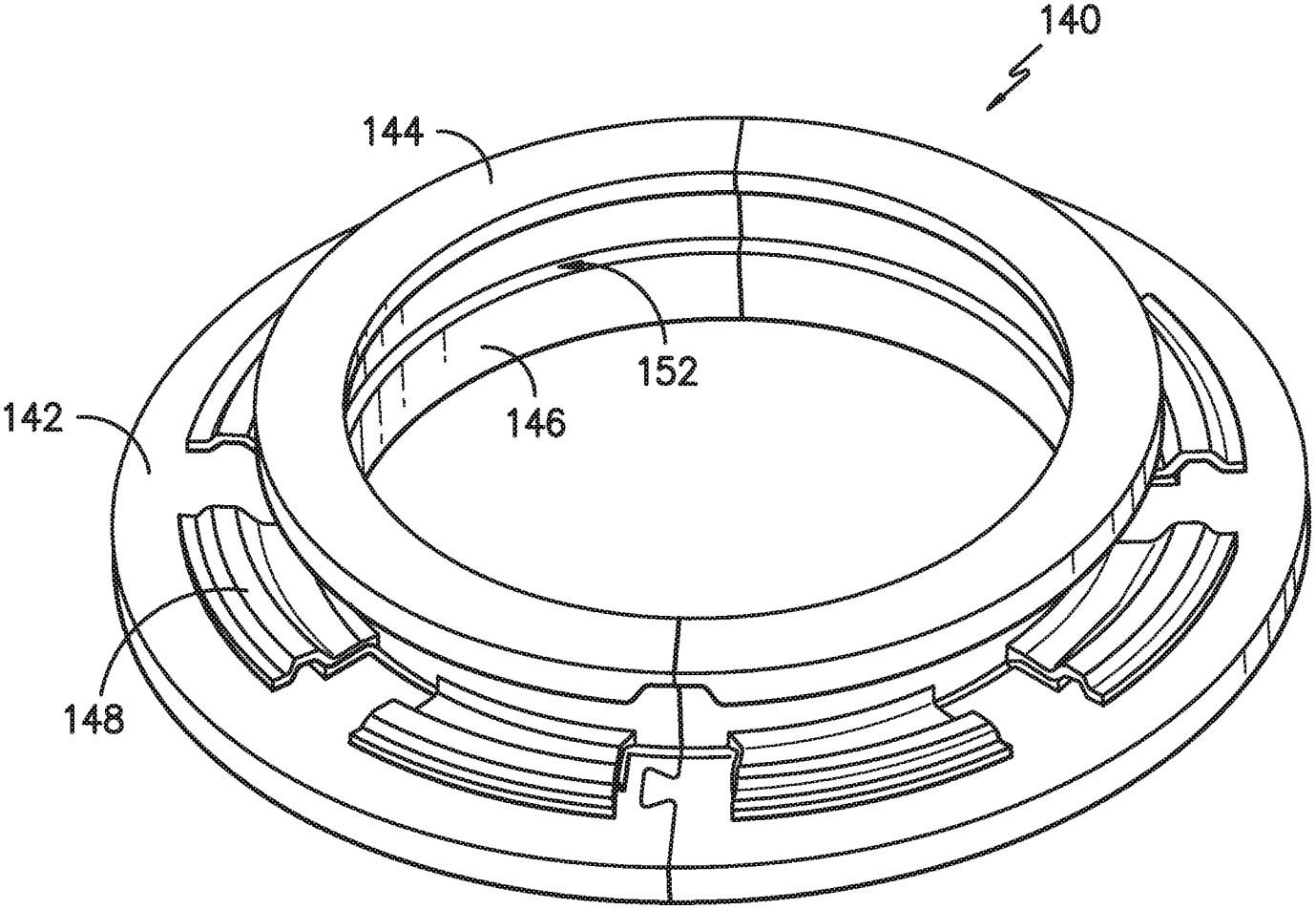
FIG. 10 is a perspective view of another exemplary embodiment of a portion of the seal assembly according to an aspect of the present disclosure.
Figure 11:
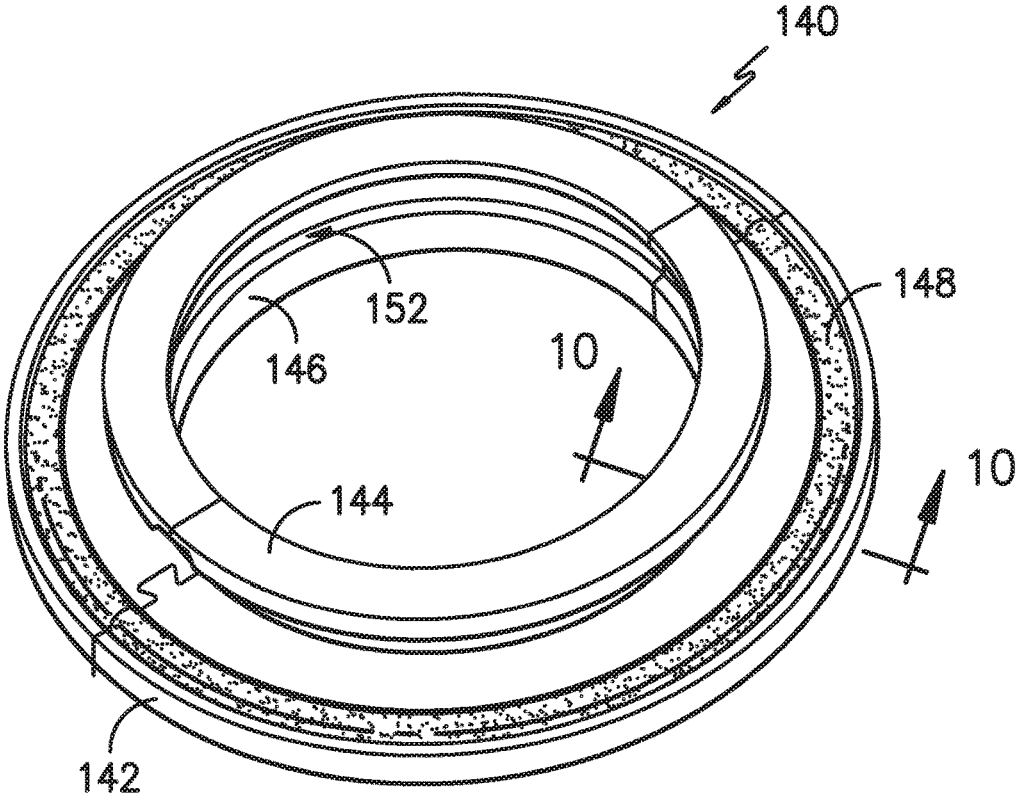
FIG. 11 is a perspective view of another exemplary embodiment of a portion of the seal assembly according to an aspect of the present disclosure.
Figure 12:
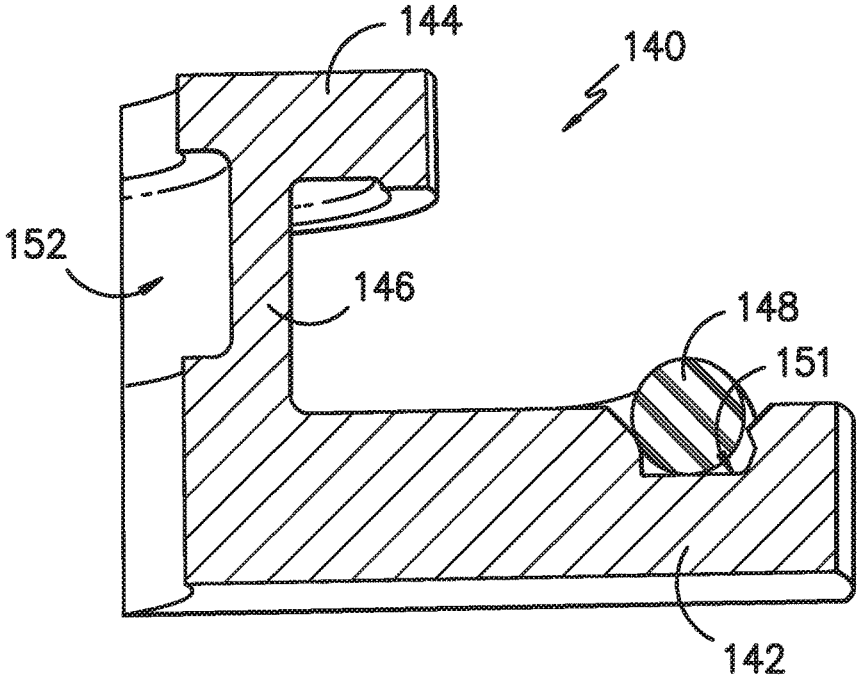
FIG. 12 is a side view of another exemplary embodiment of a portion of the seal assembly according to an aspect of the present disclosure.

Referring back to FIG. 1, and further shown and described in various embodiments in regard to FIGS. 10-12, the seal assembly 100 further includes a resilient member 148 configured to connect the retaining portion 140 to the wall assembly 110. The resilient member 148 includes springing properties, such as to define a spring or a seal, between the retaining portion 140 and the wall assembly 110. In one embodiment, the resilient member 148 is positioned between the first retaining wall 142 and the first side 111 of the wall assembly 110. The resilient member 148 contacts the first retaining wall 142 and the wall assembly 110 such as to flexibly couple the retaining portion 140 to the wall assembly 110. The resilient member 148 may generally provide flexibility relative to the longitudinal direction L or the direction of extension of the member 120. In certain embodiments, the seal assembly 100 includes the serial arrangement of the first retaining wall 142, the resilient member 148, the wall assembly 110, the locking portion 130, and the second retaining wall 144 along the longitudinal direction. In one embodiment, the serial arrangement includes direct contact of each portion to one another along the longitudinal direction L, such that the first retaining wall 142 directly contacts the resilient member 144, or the resilient member 144 directly contacts the wall assembly 110, or the wall assembly 110 directly contacts the locking portion 130, or the locking portion 130 directly contacts the second retaining wall 144, or combinations thereof.

Referring briefly to FIGS. 1 and 10, in various embodiments, the resilient member 148 is integrally connected to the retaining portion 140. In one embodiment, the resilient member 148 is integrally formed or integrally coupled to the first retaining wall 142. The resilient member 148 may be integrally formed with the retaining portion 140 via an additive manufacturing process, a casting process, a machined monolithic structure, or other appropriate manufacturing process. In other embodiments, the resilient member 148 may be attached to the retaining portion 140 via a joining process, such as, but not limited to, welding, brazing, soldering, diffusion bonding, or by use of mechanical fasteners (e.g., nuts, bolts, screw, rivets, etc.).

Referring briefly to FIGS. 11-12, in still various embodiments, the resilient member 148 may define a seal material positioned in a groove 151 (FIG. 12) extended circumferentially through the first retaining wall 142. The seal material may define a C-seal, a W-seal, or an O-ring, or other appropriate seal type. The seal material may include a relatively soft metal material, a rubber, a silicone or silicone-based material, or synthetic rubber compound, or high temperature polymer material, or other appropriate sealing material provided into the groove 151.

Referring back to FIGS. 1-3, in various embodiments, the interface 145 defining a sloped interface defines a variably extended section of the retaining portion 140 and/or the locking portion 130 extended into one another. In one embodiment, the interface 145 is defined at least partially along the circumferential direction C into the retaining portion 140, such as along an arc of a circumference of the opening 114 through the wall assembly 110. In another embodiment, the sloped interface 145 defines a variably extended section extended at least partially along the direction of extension or longitudinal direction L of the member 120 toward the locking portion 130.

Referring to the perspective view of the exemplary retaining portion 140 provided in FIG. 3, the interface 145 may generally be defined as a surface extending at least partially along the longitudinal direction L from the retaining portion 140 toward the locking portion 130. Referring to FIGS. 1 and 3, in various embodiments, the locking portion 130 includes a radial locking wall 132 (FIG. 1) extended between the second side 112 of the wall assembly 110 and the second retaining wall 144 of the retaining portion 140. The interface 145 is extended from the second retaining wall 144 along at least partially along the circumferential direction C toward the locking wall 132 of the locking portion 130. For example, the interface 145 defining a sloped interface may generally define an increasing slope along an arc through the second retaining wall 144 (e.g., increasing slope along reference direction and arc 245 in FIG. 2A and FIG. 3). A terminal end of the interface 145 may include a stop wall 147 (FIG. 3). In various embodiments, the stop wall 147 is extended at least partially co-directional to the direction of extension (e.g., longitudinal direction L) of the member 120 through the wall assembly 110.

Referring back to FIGS. 1-3, the apparatus and the seal assembly 100 may further include a seal 150 surrounding the member 120. The seal is configured to be positioned between the member 120 and the retaining portion 140. In one embodiment, the seal 150 is positioned at least partially in a notch 152 in the retaining portion 140. In another embodiment, the notch 152 is defined in the third wall 146 of the retaining portion 140 extended at least partially co-directional to the direction of extension of the member 120. The seal 150 generally surrounds the member 120 and is coupled to the retaining portion 140 and the member 120. In various embodiments, the seal 150 may define a fire seal, such as, but not limited to, a fiberglass reinforced silicone rubber or other appropriate flexible sealing material. The seal 150 may additionally, or alternatively, include a fire resistant or fire proof material.

Referring now to FIGS. 4-7, perspective views of the apparatus 10 depicting a method for assembly of the seal assembly 100 are generally provided. In various embodiments, the retaining portion 140 includes two or more separable retaining portions 140*a*, 140*b* together configured to surround the member 120 and attach to the locking portion 130. In one embodiment, the retaining portions 140*a*, 140*b* are circumferentially separable such as to clamp around the member 120. In another embodiment, the seal 150 is attached to the retaining portion 140. The seal 150 may further define a separable seal 150 including two or more separable seals 150*a*, 150*b*. The two or more separable seals 150*a*, 150*b* may each be connected to respective separable retaining portions 140*a*, 140*b*.

Figure 5:
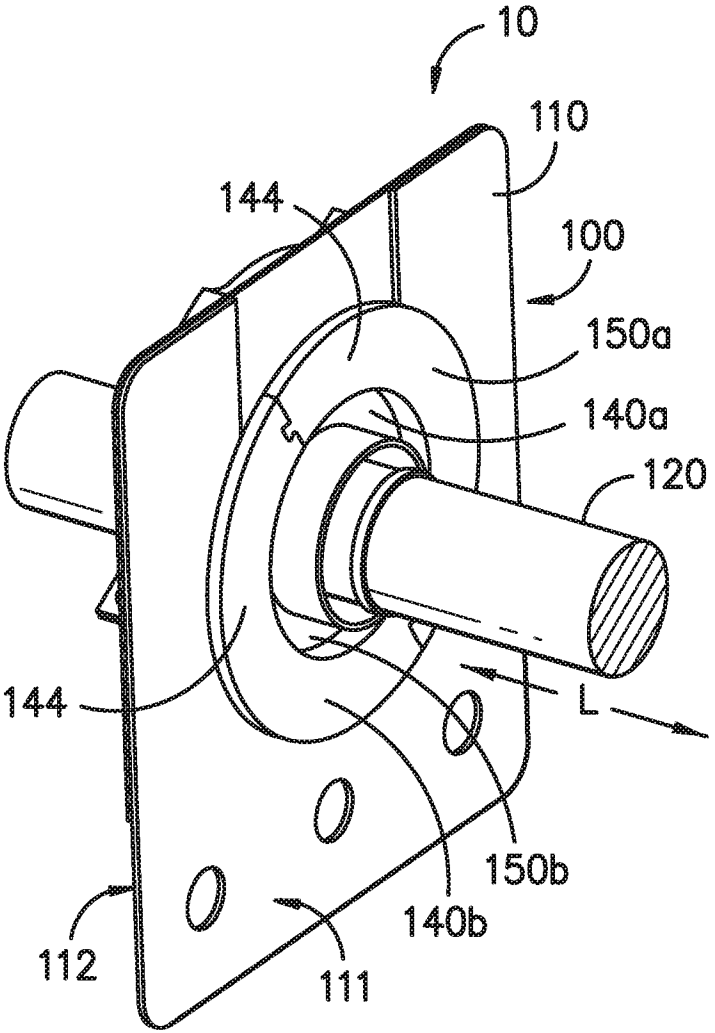
FIG. 5 is a perspective view of the exemplary apparatus including an exemplary embodiment of the seal assembly according to an aspect of the present disclosure.
Figure 4:
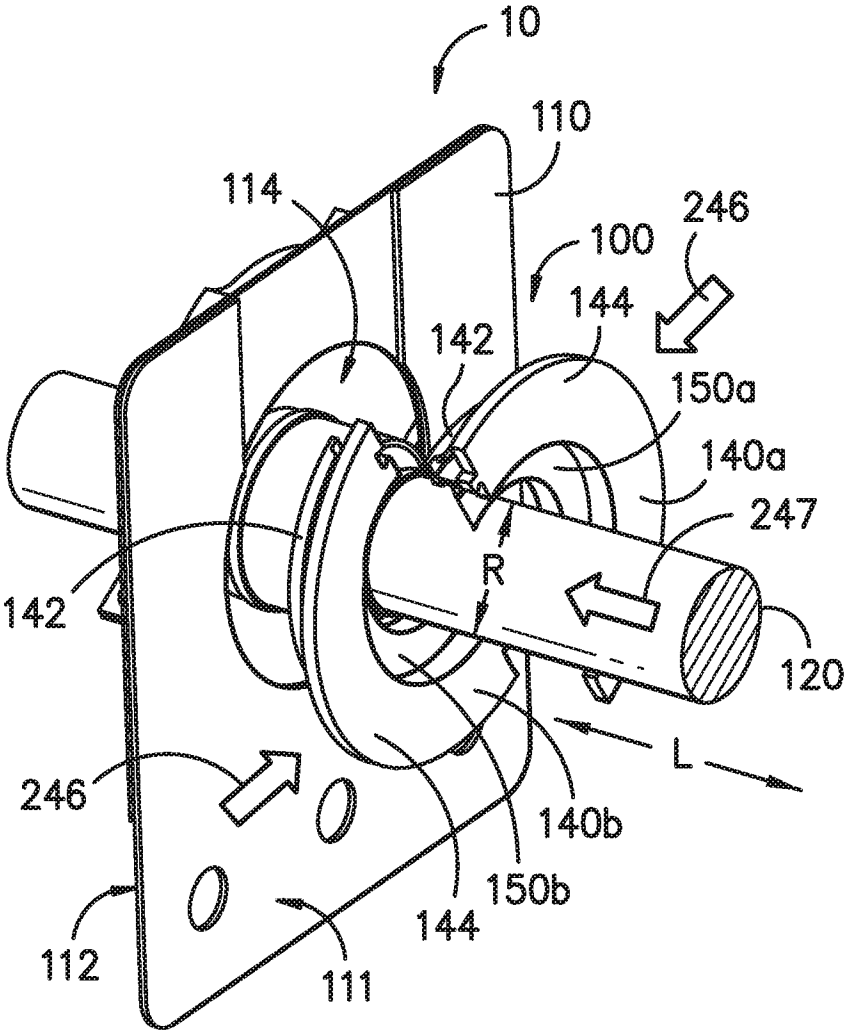
FIG. 4 is a perspective view of an exemplary apparatus including an exemplary embodiment of the seal assembly according to an aspect of the present disclosure.

Referring to FIGS. 4-5, the retaining portions 140*a*, 140*b* and the separable seals 150*a*, 150*b* together circumferentially connect and clamp around the member 120. For example, the two or more separable retaining portions 140*a*, 140*b* are positioned along reference radial direction 246 (FIG. 4) to circumferentially connect and clamp around the member 120. The connected retaining portions 140*a*, 140*b* with seals 150*a*, 150*b* are moved or positioned along the longitudinal direction L through the opening 114 of the wall assembly 110 (e.g., along reference longitudinal direction 247 in FIG. 5). For example, the retaining portions 140*a*, 140*b* are connected proximate to the first side 111 of the wall assembly 110 and pushed through the opening 114 to position the second retaining wall 144 at the second side 112 of the wall assembly 110.

Figure 7:
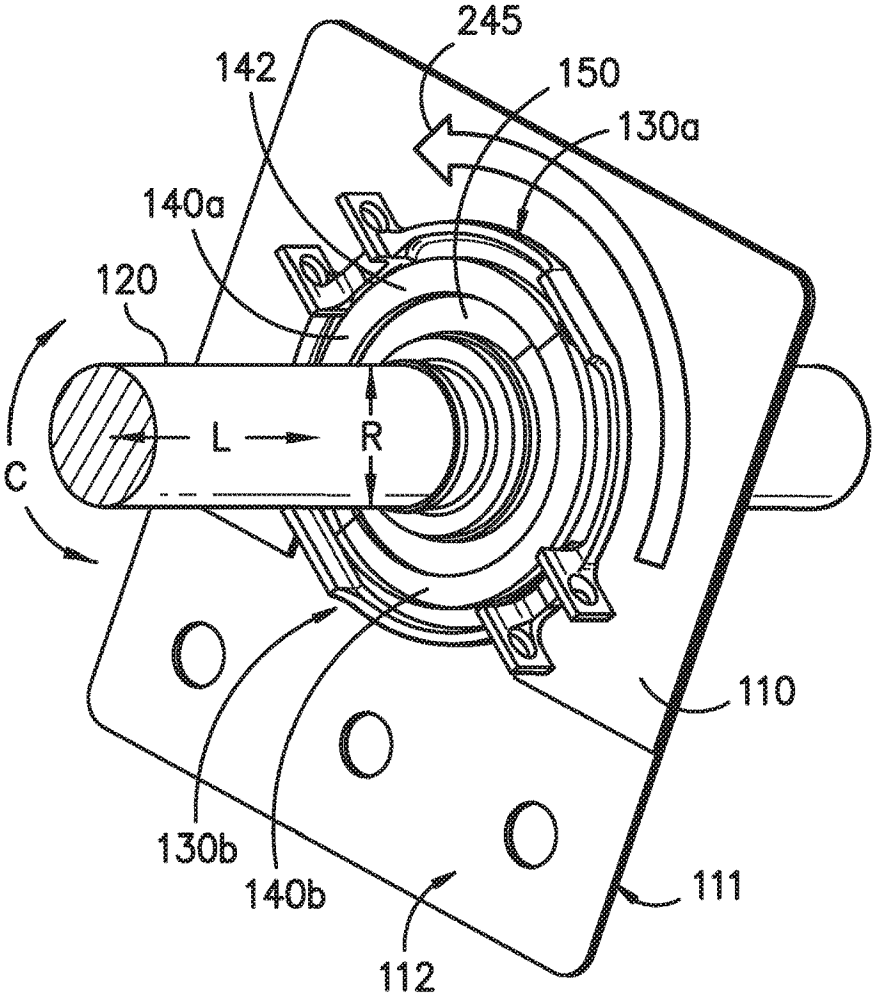
FIG. 7 is a perspective view of the exemplary apparatus including an exemplary embodiment of the seal assembly according to an aspect of the present disclosure.
Figure 6:
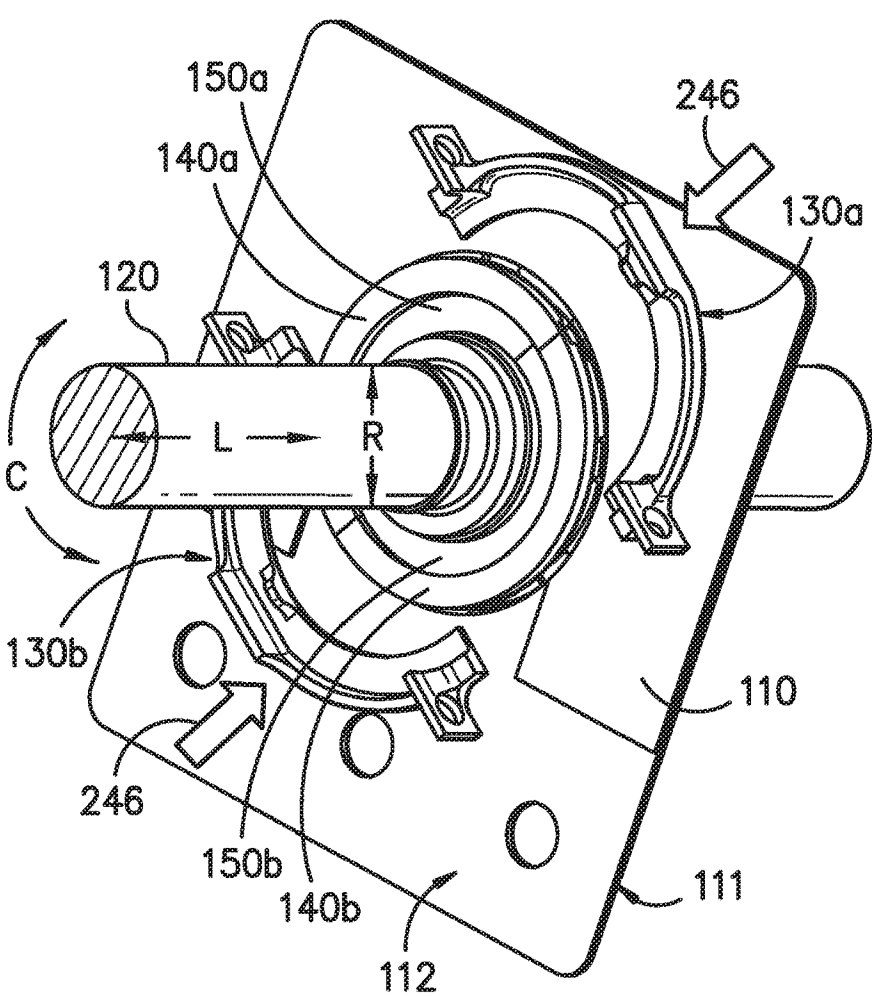
FIG. 6 is a perspective view of the exemplary apparatus including an exemplary embodiment of the seal assembly according to an aspect of the present disclosure.

Referring now to FIGS. 6-7, in various embodiments, the locking portion 130 includes two or more separable locking portions 130*a*, 130*b* together configured to surround the retaining portions 140*a*, 140*b*. The two or more separable locking portions 130*a*, 130*b* are together configured to attach to the wall assembly 110 and the retaining portions 140*a*, 140*b*. In one embodiment, the locking portions 130*a*, 130*b* are circumferentially separable such as described in regard to the retaining portions 140*a*, 140*b*. For example, the two or more separable locking portions 130*a*, 130*b* are positioned along reference radial direction 246 (FIG. 4) to circumferentially connect and clamp around the retaining portions 140*a*, 140*b*. The locking portions 130*a*, 130*b* are provided into the interface 145 (FIGS. 1-3). The locking portions 130*a*, 130*b* clamp the retaining portions 140*a*, 140*b*, the seals 150*a*, 150*b*, the member 120, and the wall assembly 110 together by way of rotation (such as along reference circumferential direction 245 in FIG. 7) of the locking portion 130*a*, 130*b* within the interface 145 (FIGS. 1-3), such as to provide a friction fit between the locking portion 130 and the retaining portion 140 such as further described herein.

Figure 8A:
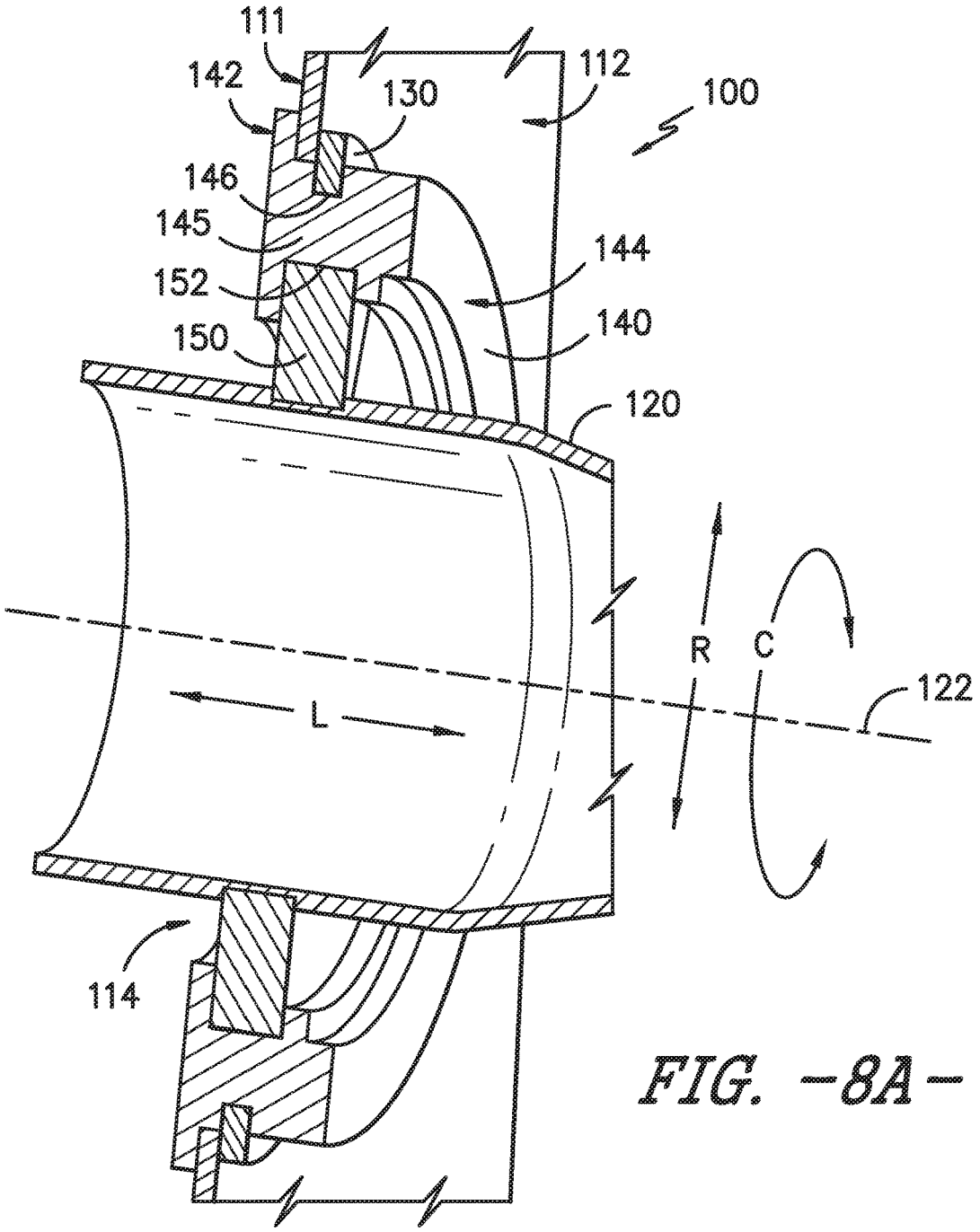
FIG. 8A is a perspective view of an exemplary embodiment of a portion of the seal assembly according to an aspect of the present disclosure.
Figure 8B:
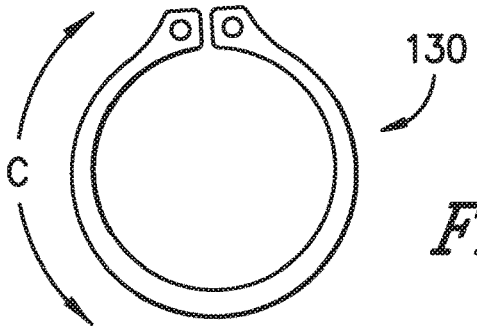
FIG. 8B is a perspective view of an exemplary embodiment of a locking portion of the seal assembly according to an aspect of the present disclosure.
Figure 9:
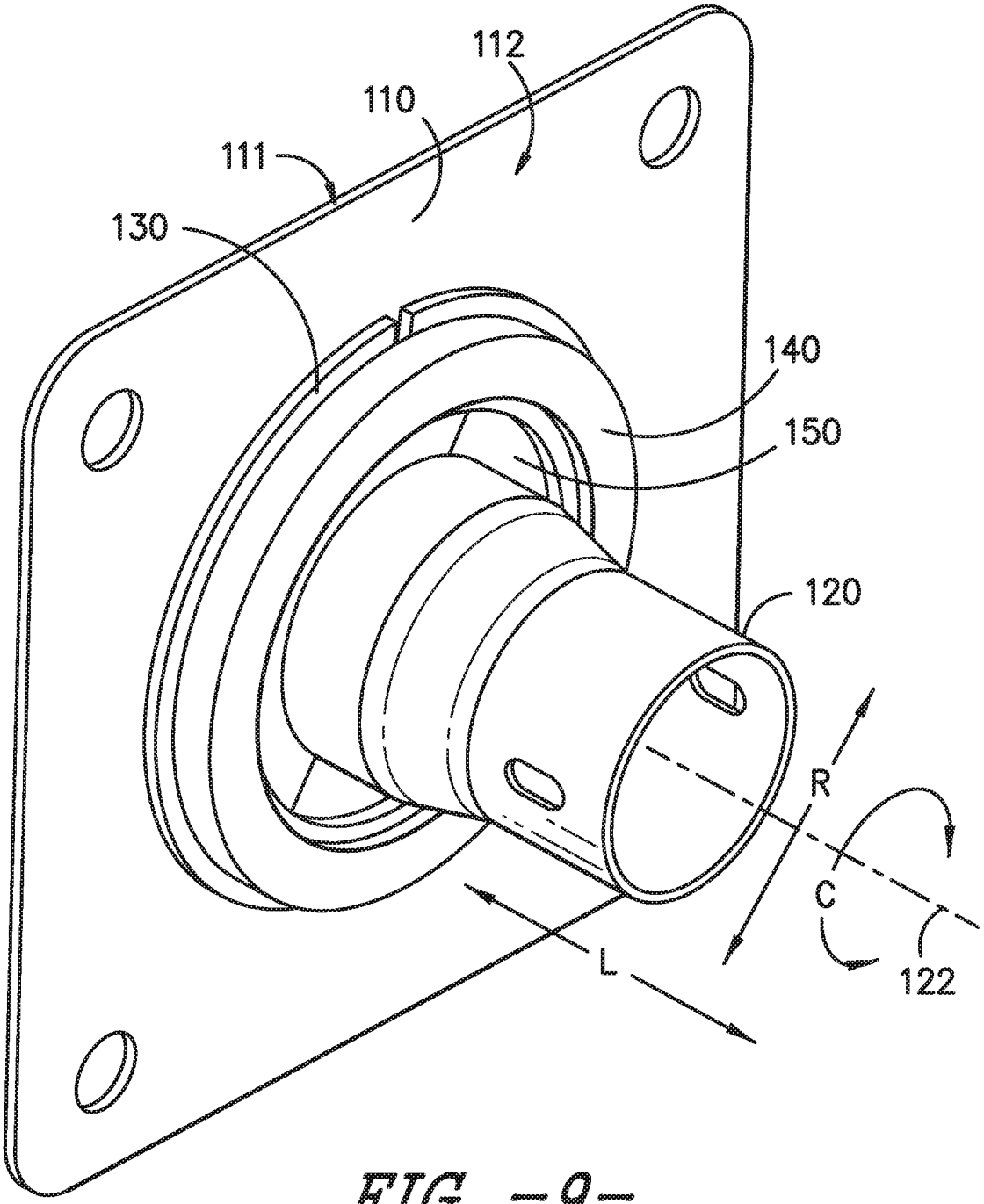
FIG. 9 is a perspective view of an exemplary embodiment of the seal assembly according to an aspect of the present disclosure.

Referring to FIGS. 8A-8B and FIG. 9, in some embodiments, the locking portion 130 includes a single or monolithic piece. Referring to FIG. 8B, in certain embodiments, the locking portion 130 defines a retainer ring or snap ring. The locking portion 130 is placed around the one or more retaining portions 140. In various embodiments described herein, the locking portion 130 is placed in a space or cavity between the second retaining wall 144 and the second side 112 of the wall assembly 110. In certain embodiments, the locking portion 130 is placed in a space or cavity between the second retaining wall 144, the second side 112 of the wall assembly 110, and the third wall 146 of the retaining portion 140. In various embodiments shown and described herein, the seal assembly 100 includes the serial arrangement of the wall assembly 110, the locking portion 130, and the second retaining wall 144 in direct contact with one another.

Referring back to FIGS. 1-3, and further in regard to FIGS. 4-9, the locking portion 130 is sealingly attached to the wall assembly 110 and the retaining portion 140 via a friction fit at the interface 145. In various embodiments, the friction fit at the locking portion 130 includes a key 136 extendable within the interface 145. The locking portion 130 including the key 136 may be provided into the interface 145 through a slot 149 in the retaining portion 140, such as the second retaining wall 144 of the retaining portion 140. In various embodiments, the key 136 is configured to be extended toward the second side 112 of the wall assembly 110. The slot 149 and key 136 may further correspond to one another, such as to provide the locking portion 130 to between the wall assembly 110 and the second retaining wall 144 of the retaining portion 140.

Referring still to FIGS. 1-3, in various embodiments, a protrusion 134 is extended from the locking portion 130 to the wall assembly 110. In one embodiment, the protrusion 134 is extended from the locking wall 132 to contact the second side 112 of the wall assembly 110 when assembled. The protrusion 134 may variably extend from the locking portion 130 to the wall assembly 110 relative to at least a portion of the circumference of the opening 114 through the wall assembly 110. In one embodiment, the wall assembly 110 defines a contact surface 116 at which the protrusion 134 is extended from the locking portion 130 in contact with the wall assembly 110. In certain embodiments, the contact surface 116 is defined at the second side 112 of the wall assembly 110. The protrusion 134 at the locking portion 130 is extended into the contact surface 116 at the second side 112 of the wall assembly 110. In still various embodiments, the protrusion 134 is extended toward the second side 112 of the wall assembly 110 and further at least partially circumferentially from the locking wall 132 of the locking portion 130. The contact surface 116 may define a depression, a sloped interface (e.g., configured such as shown and described in regard to the interface 145), or another surface at which the wall assembly 110 is configured to retain the locking portion 130 in contact with the wall assembly 110. In still various embodiments, the contact surface 116 may extend at least partially circumferentially into the second side 112 of the wall assembly 110 (e.g., the contact surface 116 corresponds circumferentially to the protrusion 134 at the locking portion 130).

During assembly and locking of the seal assembly 100, the key 136 may be positioned through the slot 149 into the interface 145. The locking portion 130 is rotated relative to the retaining portion 140. The key 136 contacts the interface 145 at the retaining portion 140. The increased slope of the interface 145 defining the sloped interface toward the key 136 at the locking portion 130 generates a retention force between the locking portion 130 and the retaining portion 140. The stop wall 147 may further provide a rotational limit or stop to the locking portion 130 within the interface 145. The retention force between the locking portion 130 and the retaining portion 140 further generates a force against the resilient member 148 compressed between the first retaining wall 142 and the first side 111 of the wall assembly 110. As such, the resilient member 148 is connected to the first retaining wall 142 and the wall assembly 110 at the first side 111 and the locking portion 130 is sealingly attached to the second retaining wall 144 and the wall assembly 110 at the second side 112. In various embodiments, the protrusion 134 may further provide a gripping or retention surface between the locking portion 130 and the wall assembly 110.

Embodiments of the apparatus 10 and seal assembly 100 provided herein may be configured for wall pass-through sealing structures generally. In certain embodiments, the apparatus 10 and seal assembly 100 are configured to provide fire prevention, fire protection, thermal isolation, thermal isolation, and/or fluid isolation between a relatively hazardous zone and a relatively sensitive zone. In various embodiments, the member 120 may include an electrical wire, wiring harness, electrical wiring interconnection system, electrical terminal or junction, or other electrical system passed through the wall assembly 110. In other embodiments, the member 120 is a fluid conduit, such as a fuel, lubricant, hydraulic fluid, air, or other liquid and/or gaseous fluid, including flammable or volatile fluids.

In still certain embodiments, the wall assembly 110 defines a firewall, bulkhead wall, fire barrier, or other barrier structure defining a hazardous zone configured to be thermally or fluidly separate from a relatively sensitive environmental zone. In one embodiment, one side of the wall assembly 110 (e.g., the first side 111) defines a hazardous zone at which fire, heat, combustion, or volatility, or the risk thereof, may be more present or greater in contrast to another side of the wall assembly 110 (e.g., the second side 112). In certain embodiments, the other side of the wall assembly 110 (e.g., the second side 112) defines a relatively sensitive environmental zone at which an electrical component, a combustible or flammable fluid or container thereof, or thermally sensitive area in general is disposed in contrast to one side of the wall assembly 110 (e.g., the first side 111). However, it should be appreciated that in other embodiments, the first side 111 may define the relatively sensitive environmental zone and the second side 112 may define the hazardous zone.

In some embodiments, the wall assembly 110 and/or the seal assembly 100, or portions thereof, including, but not limited to, the locking portion 130, the retainer portion 140, the seal 150, are configured to accept temperatures of approximately 1180 degrees Celsius or greater without substantial deformation or leakage between the first side 111 and the second side 112 of the wall assembly 110. In some embodiments, the seal 150 includes polytetrafluoroethylene (PTFE), polyetheretherketone (PEEK), fluorosilicone, or silicone, or other appropriate polymer or silicone-based material. In various embodiments, the seal 150 includes a material based at least on an auto-ignition temperature, a flash point, or volatility of a fluid within the member 120 or may be present at the first side 111 and/or the second side 112 of the wall assembly 110. In still yet various embodiments, the seal assembly 100, or portions thereof, include one or more materials based on an expected temperature at the hazardous zone or other temperature corresponding to a combustion or volatility point of a fluid or material failure at the first side 111, the second side 112, or both.

Figure 13:
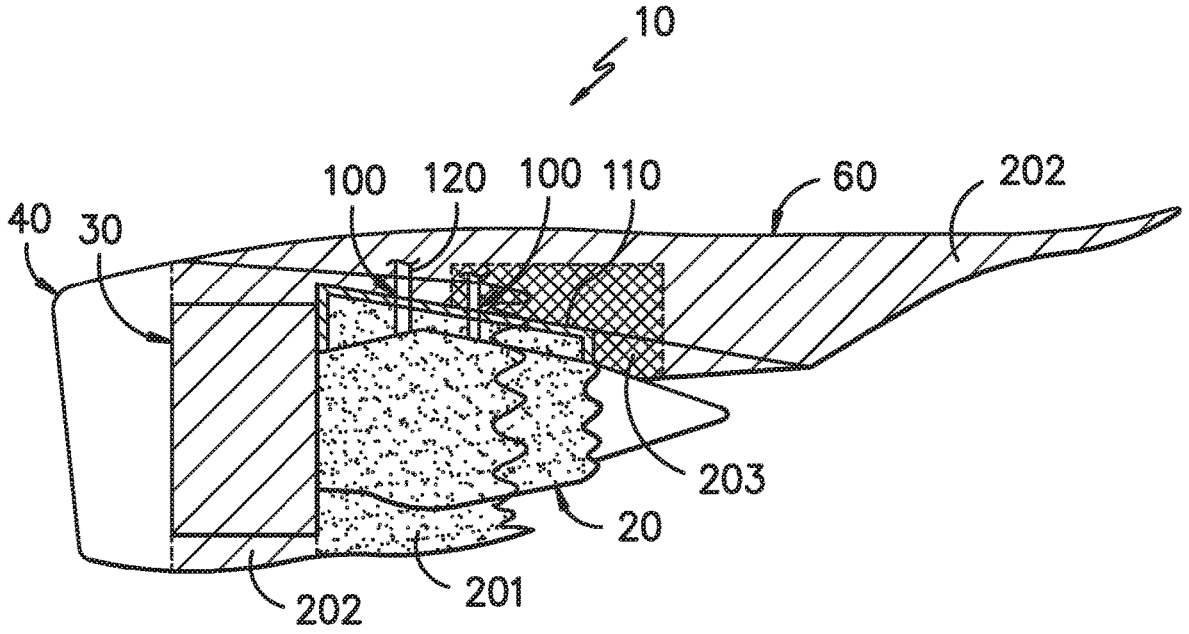
FIG. 13 is a side view of an exemplary embodiment of the apparatus including the seal assembly according to an aspect of the present disclosure.
Figure 14:
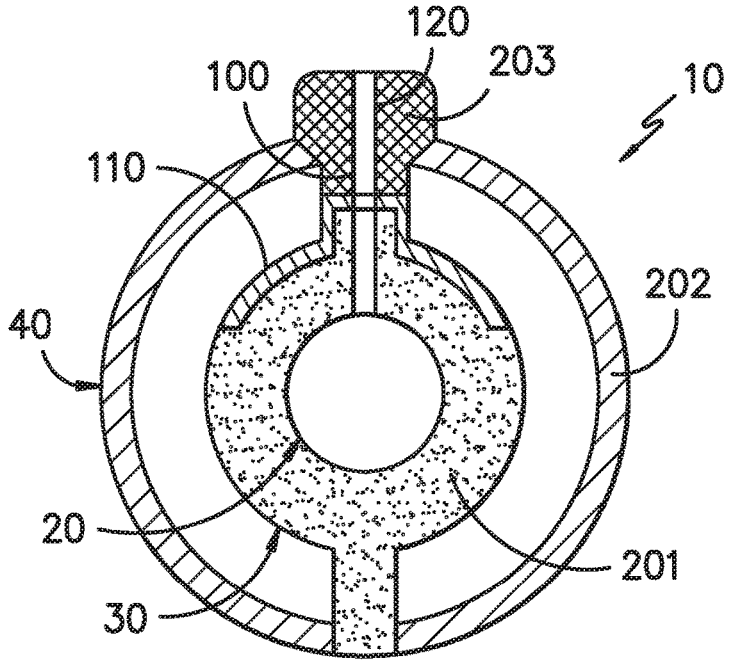
FIG. 14 is a circumferential view of an exemplary embodiment of the apparatus including the seal assembly according to an aspect of the present disclosure.

Referring now to FIGS. 13-14, exemplary embodiments of the apparatus 10 including a heat engine, turbo machine, gas turbine engine, or propulsion system are provided. In certain embodiments, the apparatus 10 is an aircraft gas turbine engine auxiliary power unit (APU) or propulsion system, a marine gas turbine engine power generation unit or propulsion system, or a power generation unit for a land-based industrial application or land vehicle. In the exemplary embodiment provided, the apparatus 10 defining a heat engine includes an engine core 20 operably coupled to a fan assembly 30. At least a portion of the fan assembly 30 and the engine core 20 may generally be surrounded by a nacelle 40. Various fluid containers, fluid conduits, electrical conduits, controls, valves, actuators, or other subsystems may generally be positioned, at least in part, between the engine core 20 and the fan assembly 30. The engine core 20 and fan assembly 30 are together connected and further connected to a mount structure or pylon 50, such as a mount structure for a propulsion system to an aircraft. Additional or other fluid containers, fluid conduits, electrical conduits, controls, valves, actuators, or other subsystems may further be positioned or routed, at least in part, through the pylon 50.

It should be appreciated that the engine core 20 defines a generally hot section of the apparatus 10 at which oxidizer is compressed and mixed with a liquid or gaseous fuel and burned to generate thrust. The engine core 20 is operably coupled to the fan assembly 30 such that the burned fuel/oxidizer mixture at the engine core 20 provides motive force to operate a fan rotor (not shown) at the fan assembly 30. Generally, a majority of the thrust is provided by the fan assembly 30. The fan assembly 30 may further include casings, vanes, struts, or other mount structures (not shown) connecting the engine core 20 to the fan assembly 30. The fan assembly 30 may further include fluid containers, such as fuel tanks or lubricant tanks, or other flammable fluids, etc. and conduits or manifolds to provide fluids to the engine core 20.

In various embodiments, the apparatus 10 defines a first zone 201 corresponding to sources of ignition, such as the engine core 20 (e.g., sources of ignition including high material temperatures, igniters at a combustion section, etc.). The apparatus 10 may further define a second zone 202 corresponding to sources of flammable fluids, such as described above in regard to the fan assembly 30, the nacelle 40, and/or the pylon 50. In still another embodiment, the apparatus 10 may define a third zone 203 corresponding to areas that are desirably dry or free of fluids. The third zone 203 may correspond to places at which electrical components, controllers, computing systems, or systems that are desirably or substantially free of liquids or fluids are positioned. In various embodiments, zones 202, 203 correspond to an environmentally sensitive zone and first zone 201 corresponds to a hazardous zone. In still various embodiments, the first side 111 of the wall assembly 110 is at the first zone 201 and the second side 112 of the wall assembly 110 is at the second zone 202 or the third zone 203.

In one embodiment, the wall assembly 110, such as described in regard to FIGS. 1-10 may provide a barrier structure separating the zones 201, 202, 203 from one another. The member 120 may be configured to pass through the wall assembly 110 into two or more zones 201, 202, 203. The member 120 may further provide fluid and/or thermal separation from within the member 120 to the zone 201, 202, 203 surrounding the member 120. As such, the seal assembly 100 may further separate the zones 201, 202, 203 from one another at a junction or point at which the member 120 passes through the wall assembly 110 from one zone to another.

It should be appreciated that various embodiments of the seal assembly 100, the wall assembly 110, the member 120, and other structures shown and described herein may provide benefits particular to gas turbine engines generally, or aircraft gas turbine engines specifically. For example, one or more embodiments shown and described herein may be particularly beneficial for separating hazardous zones from environmentally sensitive zones, such as to disable propagation of undesired fluids or physical conditions through one or more openings at the wall assembly. Such separation may mitigate uncontained failures, mitigate propagation of fire or adverse thermal events, or mitigate further or complete failure of the apparatus 10, such as the apparatus 10 defining a gas turbine engine or propulsion system for an aircraft. Additionally, or alternatively, one or more embodiments shown and described herein may provide improvements to seal assemblies and/or wall assemblies not previously known the art, such as, but not limited to, improved accessibility, such as to improve component maintainability or replacement, and/or improved mitigation of adverse fluid events, such as, but not limited to, thermal, liquid, or chemical damage to one or more components at an environmentally sensitive zone.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

Further aspects of the invention are provided by the subject matter of the following clauses:

1. A seal assembly for a wall assembly and a member extended through the wall assembly, wherein the wall assembly defines an opening through which the member is extended, and wherein the wall assembly defines a first side and a second side opposite of the first side along a direction of extension of the member through the wall assembly. The seal assembly comprises a retaining portion extended at least partially co-directional to the member, the retaining portion configured to couple around the member and extend through the opening, and a locking portion configured to sealingly attach to the wall assembly and the retaining portion at an interface between the locking portion and the retaining portion.

2. The seal assembly of any preceding clause, wherein the interface defines a sloped interface at which one or more of the retaining portion or the locking portion is extended into one another.

3. The seal assembly of any preceding clause, wherein the sloped interface defines a variably extended portion that is extended relative to at least an arc of a circumference of the opening through the wall assembly.

4. The seal assembly of any preceding clause, wherein the locking portion is sealingly attached to the wall assembly and the retaining portion via a friction fit.

5. The seal assembly of any preceding clause, wherein the friction fit at the locking portion comprises a protrusion extended from the locking portion to the wall assembly.

6. The seal assembly of any preceding clause, wherein the protrusion extended from the locking portion is variably extended from the locking portion to the wall assembly relative to at least a portion of a circumference of the opening through the wall assembly.

7. The seal assembly of any preceding clause, the retaining portion comprising a first retaining wall extended at least partially perpendicular to the direction of extension of the member, wherein the first retaining wall is configured to be positioned adjacent to the first side of the wall assembly, and a second retaining wall extended at least partially perpendicular to the direction of extension of the member, wherein the second retaining wall is configured to be positioned adjacent to the second side of the wall assembly.

8. The seal assembly of any preceding clause, wherein the locking portion comprises a key configured to be extended toward the second side of the wall assembly, and further wherein the retaining portion comprises a slot through the second retaining wall, the slot corresponding to the key at the locking portion.

9. The seal assembly of any preceding clause, further comprising a resilient member configured to connect the retaining portion to the wall assembly.

10. The seal assembly of any preceding clause, wherein the resilient member is configured to be positioned between the first side of the wall assembly and a first retaining wall of the retaining portion, the first retaining wall configured to be extended adjacent to the first side of the wall assembly.

11. The seal assembly of any preceding clause, wherein the resilient member is integrally connected to the first retaining wall.

12. The seal assembly of any preceding clause, wherein the resilient member comprises springing properties.

13. The seal assembly of any preceding clause, further comprising a seal configured to be positioned between the member and the retaining portion, the seal and the retaining portion each configured to surround the member.

14. The seal assembly of any preceding clause, wherein the retaining portion comprises two or more separable retaining portions together configured to surround the member, the two or more retaining portions configured to attach to the locking portion.

15. The seal assembly of any preceding clause, wherein the locking portion comprises two or more separable locking portions together configured to surround the retaining portion, the two or more separable locking portions together configured to attach to the wall assembly and the retaining portion.

16. An apparatus comprising a wall assembly defining an opening through which a member is extended, wherein the wall assembly defines a first side and a second side opposite of the first side along a direction of extension of the member through the wall assembly, and a retaining device comprising a retaining portion of any preceding clause extended at least partially co-directional to the member; and a resilient member coupled to the retaining portion and the wall assembly, and a seal of any preceding clause surrounding the member, the seal coupled to the retaining portion and the member; and a locking portion of any preceding clause sealingly attached to the wall assembly and the retaining portion at an interface extended at least partially circumferentially around the member, the interface positioned between the locking portion and the retaining portion.

17. The apparatus of any preceding clause, wherein the retaining portion of any preceding clause comprises a first retaining wall extended at least partially perpendicular to the direction of extension of the member, wherein the first retaining wall is positioned adjacent to the first side of the wall assembly, and a second retaining wall extended at least partially perpendicular to the direction of extension of the member, wherein the second retaining wall is positioned adjacent to the second side of the wall assembly.

18. The apparatus of any preceding clause, wherein the resilient member is connected to the first retaining wall and the wall assembly at the first side, and wherein the locking portion is sealingly attached to the second retaining wall and the wall assembly at the second side.

19. The apparatus of any preceding clause, wherein the interface is defined at least partially circumferentially at the second retaining wall, and wherein the interface defines a variably extended section extended at least partially along the direction of extension of the member toward the locking portion.

20. The apparatus of any preceding clause, wherein the wall assembly defines a depression at which a protrusion is extended from the locking portion in contact with the wall assembly.

21. The apparatus of any preceding clause, wherein the protrusion extended from the locking portion is variably extended from the locking portion to the wall assembly relative to at least a portion of a circumference of the opening through the wall assembly.

22. The apparatus of any preceding clause, wherein the locking portion comprises a key configured to be extended toward the second side of the wall assembly, and further wherein the retaining portion comprises a slot through the second retaining wall, the slot corresponding to the key at the locking portion.

23. The apparatus of any preceding clause, further comprising a resilient member configured to connect the retaining portion to the wall assembly.

24. The apparatus of any preceding clause, wherein the resilient member is configured to be positioned between the first side of the wall assembly and a first retaining wall of the retaining portion, the first retaining wall configured to be extended adjacent to the first side of the wall assembly.

25. The apparatus of any preceding clause, wherein the resilient member is integrally connected to the first retaining wall.

26. The apparatus of any preceding clause, wherein the resilient member comprises springing properties.

27. The apparatus of any preceding clause, further comprising a seal configured to be positioned between the member and the retaining portion, the seal and the retaining portion each configured to surround the member.

28. The apparatus of any preceding clause, wherein the retaining portion comprises two or more separable retaining portions together configured to surround the member, the two or more retaining portions configured to attach to the locking portion.

29. The apparatus of any preceding clause, wherein the locking portion comprises two or more separable locking portions together configured to surround the retaining portion, the two or more separable locking portions together configured to attach to the wall assembly and the retaining portion.

30. The apparatus or seal assembly of any preceding clause, wherein the locking portion comprises a single or monolithic piece.

31. The apparatus or seal assembly of any preceding clause, wherein the locking portion comprises a retainer ring or a snap ring.

32. The apparatus or seal assembly of any preceding clause, wherein the apparatus is a turbo machine, a gas turbine engine, or a propulsion system.

33. The apparatus or seal assembly of any preceding clause, wherein the apparatus is a turbo machine, a gas turbine engine, or a propulsion system for an aircraft.

34. The apparatus or seal assembly of any preceding clause, wherein the wall assembly defines an opening through which a member is extended, and wherein the wall assembly separates the apparatus defining a gas turbine engine into two or more zones comprising a first zone and a second zone, the first zone comprising an ignition source and the second zone comprising a flammable fluid source, and wherein the member is extended along a direction of extension through the wall assembly and positioned at least at the first zone and the second zone.

35. The apparatus or seal assembly of any preceding clause, wherein a first retaining wall is extended at least partially perpendicular to the direction of extension of the member, wherein the first retaining wall is positioned adjacent to the wall assembly at the first zone, and a second retaining wall is extended at least partially perpendicular to the direction of extension of the member, wherein the second retaining wall is positioned adjacent to the wall assembly at the second zone.

What is claimed is:

1. A seal assembly for a wall assembly and a member extended through the wall assembly, wherein the wall assembly defines an opening through which the member is extended, and wherein the wall assembly defines a first side and a second side opposite of the first side along a direction of extension of the member through the wall assembly, the seal assembly comprising:

a retaining portion extended at least partially co-directional to the member, the retaining portion configured to couple around the member and extend through the opening; and a locking portion configured to sealingly attach to the wall assembly and the retaining portion at an interface between the locking portion and the retaining portion, wherein the locking portion is sealingly attached to the wall assembly and the retaining portion via a friction fit, and wherein the friction fit at the locking portion comprises a protrusion extended from the locking portion to the wall assembly.

2. The seal assembly of claim 1, wherein the interface defines a sloped interface at which the retaining portion or the locking portion, or both is are extended into one another.

3. The seal assembly of claim 2, wherein the sloped interface defines a variably extended portion that is extended relative to at least an arc of a circumference of the opening through the wall assembly.

4. The seal assembly of claim 1, wherein the protrusion extended from the locking portion is variably extended from the locking portion to the wall assembly relative to at least a portion of a circumference of the opening through the wall assembly.

5. The seal assembly of claim 1, the retaining portion comprising:

a first retaining wall extended at least partially perpendicular to the direction of extension of the member, wherein the first retaining wall is configured to be positioned adjacent to the first side of the wall assembly; and a second retaining wall extended at least partially perpendicular to the direction of extension of the member, wherein the second retaining wall is configured to be positioned adjacent to the second side of the wall assembly.

6. The seal assembly of claim 5, wherein the locking portion comprises a key configured to be extended toward the second side of the wall assembly, and further wherein the retaining portion comprises a slot through the second retaining wall, the slot corresponding to the key at the locking portion.

7. The seal assembly of claim 1, further comprising:

a seal configured to be positioned between the member and the retaining portion, the seal and the retaining portion each configured to surround the member.

8. The seal assembly of claim 1, wherein the retaining portion comprises two or more separable retaining portions together configured to surround the member, the two or more retaining portions configured to attach to the locking portion.

9. The seal assembly of claim 1, wherein the locking portion comprises two or more separable locking portions together configured to surround the retaining portion, the two or more separable locking portions together configured to attach to the wall assembly and the retaining portion.

10. An apparatus, the apparatus comprising:

a wall assembly defining an opening through which a member is extended, wherein the wall assembly defines a first side and a second side opposite of the first side along a direction of extension of the member through the wall assembly;

a retaining device comprising:

a retaining portion extended at least partially co-directional to the member; and a resilient member coupled to the retaining portion and the wall assembly;

a seal surrounding the member, the seal coupled to the retaining portion and the member; and a locking portion sealingly attached to the wall assembly and the retaining portion at an interface extended at least partially circumferentially around the member, the interface positioned between the locking portion and the retaining portion, wherein the locking portion is sealingly attached to the wall assembly and the retaining portion via a friction fit, and wherein the friction fit at the locking portion comprises a protrusion extended from the locking portion to the wall assembly.

* * * * *